US009108379B2

(12) United States Patent
Kaneko

(10) Patent No.: US 9,108,379 B2
(45) Date of Patent: Aug. 18, 2015

(54) TANDEM PRESS LINE

(75) Inventor: Sotoyuki Kaneko, Hahusan (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 190 days.

(21) Appl. No.: 13/455,470

(22) Filed: Apr. 25, 2012

(65) Prior Publication Data

US 2012/0272839 A1 Nov. 1, 2012

(30) Foreign Application Priority Data

Apr. 27, 2011 (JP) ..... 2011-099257

(51) Int. Cl.
*B30B 15/26* (2006.01)
*B30B 15/14* (2006.01)

(52) U.S. Cl.
CPC ..... *B30B 15/146* (2013.01)

(58) Field of Classification Search
CPC ..... B30B 15/14; B30B 15/146; B30B 15/148
USPC ..... 100/207, 137–140, 43, 48; 72/20.1, 72/20.2, 21.3, 443
See application file for complete search history.

(56) References Cited

U.S. PATENT DOCUMENTS 3,199,439 A * 8/1965 Danly ..... 100/43
3,553,547 A * 1/1971 Heiberger ..... 318/85
3,557,686 A * 1/1971 Sapolsky ..... 100/43
3,621,348 A * 11/1971 Uchida et al. ..... 318/77
3,948,162 A * 4/1976 Numba ..... 100/45
3,991,350 A * 11/1976 Miyagoshi ..... 318/85
4,314,185 A * 2/1982 Schneider et al. ..... 318/85
4,378,592 A * 3/1983 Heiberger et al. ..... 700/206
4,408,281 A * 10/1983 Tack et al. ..... 700/206
4,414,887 A * 11/1983 Orii ..... 100/45
4,492,901 A * 1/1985 Higashi ..... 318/85
7,428,837 B2 9/2008 Takayama (Continued)

FOREIGN PATENT DOCUMENTS

JP 2000-117367 A 4/2000
JP 2008-246529 A 10/2008

(Continued)

OTHER PUBLICATIONS

Japanese Notification of Reasons for Refusal, w/ English translation thereof, issued in Japanese Patent Application No. JP 2011-099257 dated Apr. 2, 2014.

*Primary Examiner* — Shelley Self
*Assistant Examiner* — Leonel Vasquez
(74) *Attorney, Agent, or Firm* — McDermott Will & Emery LLP

(57) ABSTRACT

A tandem press line switches from a synchronized high-speed press control to a synchronized low-speed press control when a high-speed, line master control signal is switched to a low-speed line master control signal. For a press having a slide position which has been determined to be within a press region, the synchronized low-speed press control can be switched to a non-synchronized high-speed press control that is based on a non-synchronized high-speed individual press control signal that is not synchronized with the low-speed line master control signal at least during a period in which the slide position is within the press region, and the non-synchronized high-speed press control can be switched to the synchronized low-speed press control on condition that a press resynchronization point has been reached.

11 Claims, 6 Drawing Sheets

(56) References Cited

U.S. PATENT DOCUMENTS

| | | | | |
|---|---|---|---|---|
| 7,650,774 | B2 * | 1/2010 | Kato et al. | 72/405.11 |
| 8,096,233 | B2 * | 1/2012 | Kaneko | 100/35 |
| 8,418,606 | B2 * | 4/2013 | Onishi et al. | 100/35 |
| 8,434,405 | B2 * | 5/2013 | Matsui et al. | 100/35 |
| 2013/0104613 | A1 * | 5/2013 | Kaneko et al. | 72/20.5 |

FOREIGN PATENT DOCUMENTS

| | | | |
|---|---|---|---|
| JP | 2008-254054 | A | 10/2008 |
| JP | 2009-172662 | A | 8/2009 |
| JP | 2010-012511 | A | 1/2010 |
| WO | 2004/096533 | A1 | 11/2004 |

* cited by examiner

TANDEM PRESS LINE

Japanese Patent Application No. 2011-99257, filed on Apr. 27, 2011, is hereby incorporated by reference in its entirety.

BACKGROUND OF THE INVENTION

The present invention relates to a tandem press line that includes a plurality of presses and a plurality of transfer systems that are alternately disposed in a line direction, and is configured so that each press can be subjected to synchronized press control using an individual press control signal that corresponds to and is synchronized with a line master control signal, and each transfer system can be subjected, to synchronized transfer control using an individual transfer control signal that corresponds to and is synchronized with the line master control signal.

A tandem press line has been known in which a plurality of presses and a plurality of transfer systems are alternately disposed in a line direction. A workpiece is transferred to the first press from a material feeder that is disposed on the upstream side in the workpiece transfer direction, sequentially transferred to the intermediate presses, and then press-formed by the final press to obtain a product. The product is transferred to a product handling system that is disposed on the downstream side of the final press. Note that the workpiece transferred to the first press is a material. A semifinished product is obtained by each intermediate press, and a product is obtained by the final press.

Such a tandem press line normally employs an alternate/intermittent operation method. Specifically, each transfer system is operated in one cycle in a state in which each press is stopped at the upper dead point (top dead center). Each transfer system removes the workpiece from the preceding-stage (upstream-side) press, and transfers the workpiece to the subsequent-stage (downstream-side) press. A transfer member of each transfer system that has transferred the workpiece stands by at a position at which interference with the press does not occur. Each press is then operated in one cycle so that the workpiece is press-formed. Each press is then stopped at the upper dead point.

The alternate/intermittent operation method has an advantage in that interference (e.g., collision) between the element of the press and the element of the transfer system can be reliably prevented, since the press and the transfer system are alternately operated. However, the alternate/intermittent operation method has a disadvantage in that productivity decreases due to wastage of time.

In order to deal with the above problem, a press line in which a press and a transfer system are operated in parallel has been proposed (see WO2004/096533A1, for example). The press line is configured so that the speed of a motor of the downstream-side press is controlled so that the downstream-side press follows the upstream-side press, and the difference in crank angle between the upstream-side press and the downstream-side press is constant. The transfer system is controlled to follow the operation of the upstream-side press and the operation of the downstream-side press, and is independently controlled at the intermediate stage (i.e., follow-target-switching parallel operation method). The follow-target-switching parallel operation method is considered, to improve productivity due to a reduction in wastage of time while preventing interference as compared with the alternate/intermittent operation method.

However, the follow-target-switching parallel operation method aims at reducing facing wear by eliminating clutch operation and braking (i.e., reducing the maintenance cost and the maintenance frequency). Therefore, the follow-target-switching parallel operation method is not advantageous for a servo press line that is not provided with a clutch, a brake, and a flywheel.

Specifically, the upstream-side press and the downstream-side press must have a relative relationship with a sufficient, allowance in terms of time when determining the relative relationship between the upstream-side press and the downstream-side press (that can be controlled at high speed) in advance, and controlling the operation of the transfer system that has a large mechanical inertia and is controlled at a relatively low speed so that the transfer system follows the operation of the upstream-side press and the operation of the downstream-side press. This makes it difficult to achieve a significant improvement in productivity. Moreover, the difference in crank angle between the upstream-side press and the downstream-side press can be made constant only when the slide motion of the upstream-side press and the slide motion of the downstream-side press are identical. Specifically, it is meaningless to achieve a constant difference in crank angle when a press line is configured so that a slide motion optimum for each press-forming operation is set for each press.

It is necessary to improve the productivity of the entire press line instead, of merely improving local productivity (e.g., adjacent presses). For example, JP-A-2008-246529 discloses an integrally controlled press line that is configured so that a host controller generates a press motion parameter that optimizes the operation of each press and maximizes the operation speed of each press, a transfer motion parameter that optimizes the operation of each transfer system and maximizes the operation speed of each transfer system, and a parallel operation phase signal. The host controller outputs the press motion parameter, the transfer motion parameter, and the phase signal to a plurality of sub-controllers, and each press and each transfer system are operated using a signal from each sub-controller. Specifically, each press is subjected to synchronized press control using an individual press control signal that corresponds to and is synchronized with a line master control signal, and each transfer system is subjected to synchronized transfer control using an individual transfer control signal that corresponds to and is synchronized with the line master control signal. Since each press and each transfer system can be integrally controlled so that the performance of each press and each transfer system can be maximized while ensuring the press-forming accuracy of each press and preventing interference, productivity can be significantly improved.

An integrally controlled press line that includes an individual stop control device has been proposed (see JP-A-2009-172662, for example). Specifically, the press or the transfer system in which an abnormality has occurred is stopped. The press or the transfer system that may interfere with the press or the transfer system in which an abnormality has occurred is stopped at a position at which interference can be prevented, and the press or the transfer system that is normally operated is stopped at a normal stop position. This prevents emergency shutdown of the entire press line. This makes it possible to prevent a situation in which a press that is normally operated produces a defective product.

The method, disclosed in JP-A-2009-172662 can prevent a situation in which the press that is normally operated produces a defective product, but sequentially stops the press or the transfer system in which an abnormality has occurred, the press or the transfer system that may interfere with the press or the transfer system in which an abnormality has occurred, and the press or the transfer system that is normally operated.

Specifically, the method disclosed in JP-A-2009-172662 stops the entire press line in the same manner as emergency shutdown. This concept is contradictory to the concept of the method disclosed in WO2004/096533A1 that eliminates the disadvantage of the alternate/intermittent operation method, and is also contradictory to the concept that aims at improving productivity. The stop position of each press and each transfer system varies depending on the operation state and the like when an abnormality has occurred. This means that it takes time to resume the operation. This also results in a decrease in productivity.

An abnormality may necessarily occur when operating the press line due to mechanical, electrical, or human error. On the other hand, an improvement in productivity and quality (e.g., press-forming accuracy) is strongly desired. Therefore, it is desirable to avoid stopping the entire press line even if an abnormality has occurred in order to prevent a significant decrease in productivity. For example, it may be possible to eliminate an abnormality when temporarily reducing the operation speed.

However, when the line operation speed is reduced, in order to remove an abnormality, the press-forming accuracy may deteriorate although a significant decrease in productivity does not occur as compared with the case of stopping the entire press line. The production cost decreases due to occurrence of a defective product with a low press-forming accuracy, so that tangible productivity decreases. Therefore, development of a tandem press line that makes it possible to eliminate the cause of an abnormality without stopping the entire press line, allows continuous operation, and can maintain and improve tangible productivity, has been desired.

SUMMARY

The invention may provide a tandem press line that switches a high-speed press operation to a low-speed press operation, and maintains the press-forming accuracy even after the press operation has been switched.

According to one aspect of the invention, there is provided a tandem press line comprising a plurality of presses and a plurality of transfer systems that are alternately disposed in a line direction, doing a synchronized press control for each of the plurality of presses by using an individual press control signal that corresponds to and is synchronized with a line master control signal, and doing a synchronized transfer control for each of the plurality of transfer systems by using an individual transfer control signal that corresponds to and is synchronized with the line master control signal, the tandem press line doing a synchronized low-speed press control for each of the plurality of presses by using a low-speed individual press control signal that corresponds to and is synchronized with a low-speed line master control signal when the line master control signal has been switched from a high-speed line master control signal to the low-speed line master control signal;

the tandem press line determining whether or not a slide position of each of the plurality of presses under the synchronized low-speed press control is within a press region;

the tandem press line switching the synchronized low-speed press control to a non-synchronized high-speed press control using a non-synchronized high-speed, individual press control signal that is not synchronized with the low-speed line master control signal for a press among the plurality of presses having a slide position that has been determined to be within the press region at least during a period in which the slide position is within the press region;

the tandem press line stops the non-synchronized high-speed press control on condition that the slide position under the non-synchronized high-speed press control has reached a press resynchronization point; and the tandem press line switches the non-synchronized high-speed individual press control signal to the low-speed individual press control signal for resynchronization, and automatically switches the non-synchronized high-speed press control that has been stopped to the synchronized low-speed press control on condition that the low-speed line master control signal has reached the press resynchronization point.

DETAILED DESCRIPTION OF THE EMBODIMENT

Figure 1:
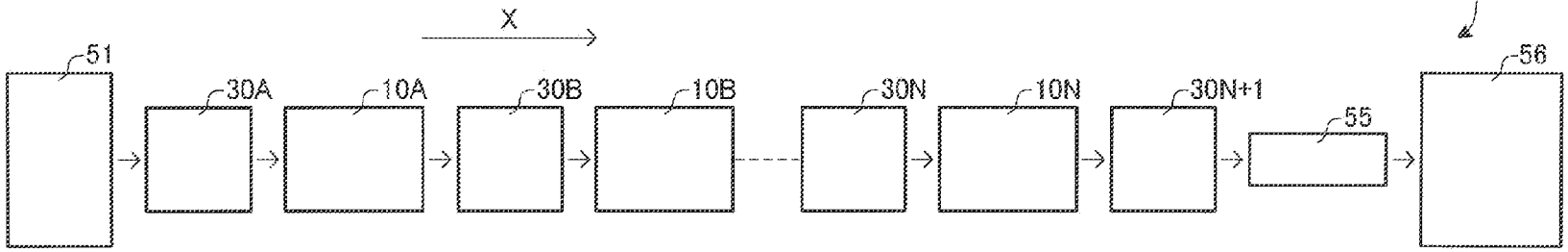
FIG. 1 is a block diagram illustrating a tandem press line according to one embodiment of the invention.

It was found by analysis that the cause of an abnormality may normally be eliminated by a mechanical fine adjustment or manual operation during a period in which the operation speed is reduced without stopping the entire press line, and tangible productivity can be improved by preventing occurrence of a defective product. The above object may be achieved by a tandem press line that is configured so that the line operation speed can be reduced when an abnormality has occurred in order to avoid stopping the entire press line, and the press speed within a press region can be maintained at high speed even after the line operation speed has been reduced.

According to one embodiment of the invention, there is provided a tandem press line comprising a plurality of presses and a plurality of transfer systems that are alternately disposed, in a line direction, doing a synchronized press control for each of the plurality of presses by using an individual press control signal that corresponds to and is synchronized with a line master control signal, and doing a synchronized transfer control for each of the plurality of transfer systems by using an individual transfer control signal that corresponds to and is synchronized with the line master control signal, the tandem press line doing a synchronized low-speed press control for each of the plurality of presses by using a low-speed individual press control signal that corresponds to and is synchronized with a low-speed line master control signal when the line master control signal has been switched from a high-speed line master control signal to the low-speed line master control signal;

the tandem press line determining whether or not a slide position of each of the plurality of presses under the synchronized low-speed press control is within a press region;

the tandem press line switching the synchronized low-speed press control to a non-synchronized high-speed press control using a non-synchronized high-speed, individual press control signal that is not synchronized with the low-speed line master control signal for a press among the plurality of presses having a slide position that has been determined to be within the press region at least during a period in which the slide position is within the press region;

the tandem press line stops the non-synchronized high-speed press control on condition that the slide position under the non-synchronized high-speed press control has reached a press resynchronization point; and the tandem press line switches the non-synchronized high-speed individual press control signal to the low-speed individual press control signal for resynchronization, and automatically switches the non-synchronized high-speed press control that has been stopped to the synchronized low-speed press control on condition that the low-speed line master control signal has reached the press resynchronization point.

According to the tandem press line, since the press-forming accuracy can be maintained even if the press operation has been switched from the high-speed press operation to the low-speed press operation, and continuous operation can be performed, without stopping the entire press line, tangible productivity can be maintained and improved. Moreover, since the high-speed press operation can be resumed after eliminating the cause of an abnormality during continuous operation, tangible productivity can be further improved.

The tandem press line may automatically switch the high-speed line master control signal to the low-speed line master control signal when a relationship between a component of a press line in the tandem press line and a workpiece is in a state in which maintaining continuous operation is difficult.

This makes it possible to reliably prevent a situation in which the entire press line is stopped.

The tandem press line may detect the relationship is in a state in which maintaining continuous operation is difficult when a number of products remain in a product handling unit that is a component of the press line.

In this case, the operation can be more reliably and appropriately switched to the low-speed operation.

In the tandem press line, the non-synchronized high-speed individual press control signal may be an extracted high-speed individual press control signal obtained by extracting a specific range of the high-speed line master control signal including the press region.

According to this configuration, since the high-speed individual press control signal can be effectively utilized, the signal can be easily and reliably generated.

In the tandem press line, the non-synchronized high-speed individual press control signal may be an accuracy-maintaining high-speed individual press control signal that is distinct from the individual press control signal that corresponds to the high-speed line master control signal.

According to this configuration, the degree of freedom of selection of the non-synchronized high-speed individual press control signal is improved, and the signal format can be easily simplified.

In the tandem press line, the press resynchronization point may be set to an upper dead point.

According to this configuration, resynchronization for returning the press operation to the low-speed press operation can be implemented more reliably and stably.

The tandem press line may do a synchronized low-speed transfer control for each of the plurality of transfer systems by using a low-speed individual transfer control signal that corresponds to and is synchronized with the low-speed line master control signal when the line master control signal has been switched from the high-speed, line master control signal to the low-speed line master control signal;

the tandem press line may determine whether or not a transfer member of each of the plurality of transfer systems under the synchronized low-speed transfer control is positioned within a return transfer region;

the tandem press line may switch the synchronized low-speed transfer control to a non-synchronized high-speed transfer control using a non-synchronized high-speed individual transfer control signal that is not synchronized with the low-speed line master control signal for a transfer system among the plurality of transfer systems having a transfer member that has been determined to be positioned within the return transfer region at least during a period in which the transfer member is positioned within the return transfer region;

the tandem press line may stop the non-synchronized high-speed transfer control on condition that the transfer member under the non-synchronized high-speed transfer control has reached a transfer resynchronization point; and the tandem press line may switch the non-synchronized high-speed individual transfer control signal to the low-speed individual transfer control signal for resynchronization, and may automatically switch the non-synchronized high-speed, transfer control that has been stopped to the synchronized low-speed transfer control on condition that the low-speed line master control signal has reached the transfer resynchronization point.

According to this configuration, since the speed of the return transfer that moves the transfer member away from the press can be increased, interference can be more reliably prevented.

In the tandem press line, the non-synchronized high-speed individual transfer control signal may be an extracted high-speed individual transfer control signal obtained by extracting a specific range of the high-speed line master control signal including the return transfer region.

According to this configuration, since the high-speed, individual transfer control signal can be effectively utilized, the signal can be easily and reliably generated.

In the tandem press line, the non-synchronized high-speed individual transfer control signal may be an escape-exclusive high-speed individual transfer control signal that is distinct from the individual transfer control signal that corresponds to the high-speed line master control signal.

According to this configuration, the degree of freedom of selection of the non-synchronized high-speed individual transfer control signal is improved, and the signal format can be easily simplified.

In the tandem press line, the transfer resynchronization point may be set to a transfer intermediate position.

According to this configuration, resynchronization for returning the transfer operation to the low-speed transfer operation can be implemented more reliably and stably.

Exemplary embodiments of the invention are described in detail below with reference to the drawings.

Figure 2:
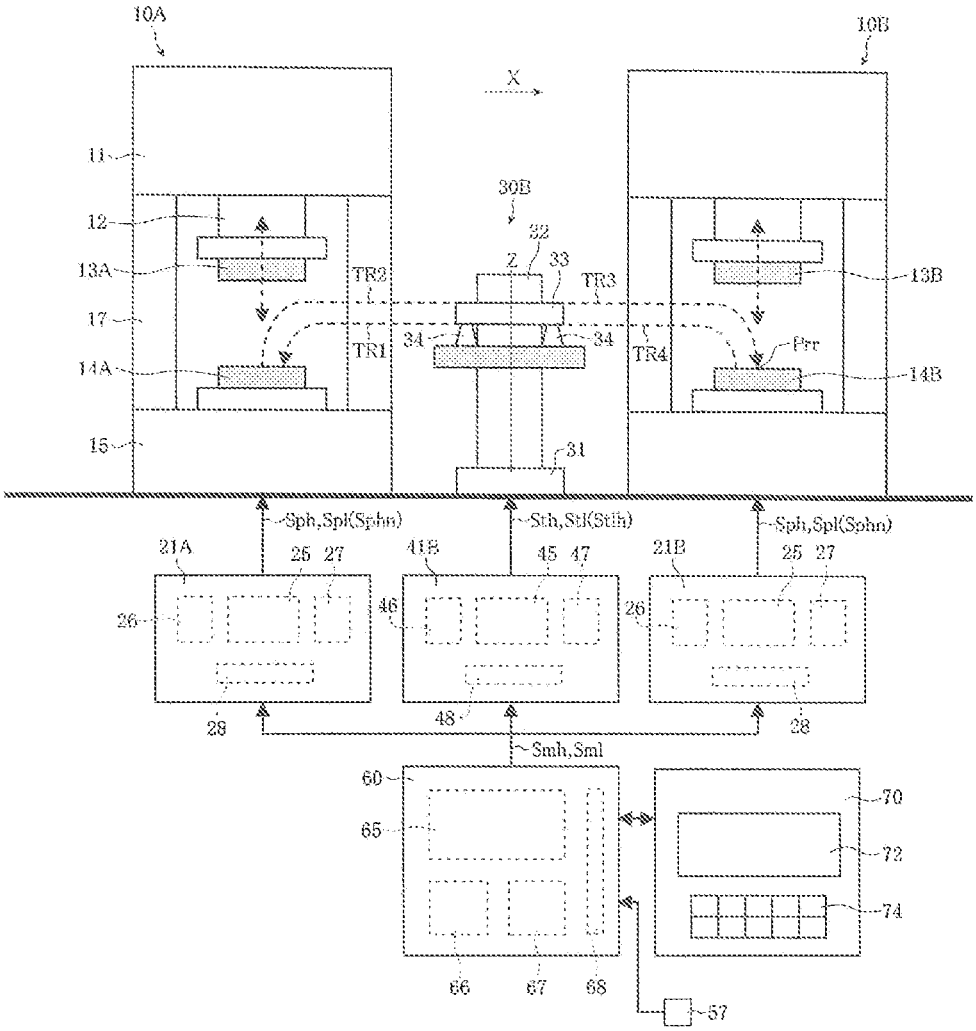
FIG. 2 is a diagram illustrating the overall configuration of a press, a transfer system, and each controller according to one embodiment of the invention.

As illustrated, in FIGS. 1 and 2, a tandem press line according to one embodiment of the invention is configured so that each press (presses 10A, 10B, . . . , and 10N in the example illustrated in FIG. 1) can be subjected to synchronized low-speed, press control using a low-speed individual press control signal Spl that corresponds to and is synchronized with a low-speed line master control signal Sml when a control signal has been switched from a high-speed line master control signal Smh to the low-speed line master control signal Sml, whether or not a slide position of each press subjected to synchronized low-speed press control is within a press region (see Aprs in FIG. 4) can be determined, a press for which it has been determined that the slide position is within the press region can be switched from synchronized low-speed press control to non-synchronized high-speed press control that is based on a non-synchronized high-speed, individual press control signal Sphn that is not synchronized with the low-speed line master control signal Sml, non-synchronized high-speed press control can be stopped on condition that the slide position has reached, a press resynchronization point (see UDP in FIG. 4) during non-synchronized high-speed press control, and the control signal can be switched from the non-synchronized high-speed individual press control signal Sphn to the low-speed individual press control signal Spl, and non-synchronized high-speed press control that has been stopped can be automatically switched to synchronized low-speed press control on condition that the low-speed line master control signal Sml has reached the press resynchronization point.

The tandem press line according to one embodiment of the invention is configured so that a plurality of presses 10A, 10B, . . . , and 10N and a plurality of transfer systems 30A, 30B, . . . , 30N, and 30N+1 are alternately disposed in a line direction (hereinafter may be referred to as "direction X") (see FIG. 1), each press can be subjected to synchronized press control using an individual press control signal Sp that corresponds to and is synchronized with a line master control signal Sm, and each transfer system can be subjected, to synchronized transfer control using an individual transfer control signal St that corresponds to and is synchronized with the line master control signal Sm.

Note that the term "individual press control signals Sp" is a generic name for the low-speed individual press control signal Spl, a high-speed individual press control signal Sph, the non-synchronized high-speed individual press control signal Sphn, and the like. The term "individual transfer control signal St" is a generic name for a low-speed individual transfer control signal Stl, a high-speed individual transfer control signal Sth, a non-synchronized high-speed individual transfer control signal Sthn, and the like. The term "line master control signals Sm" is a generic name for the low-speed line master control signal Sml, the high-speed, line master control signal Smh, and the like.

A material feeder 51 is disposed on the upstream side of the presses and the transfer systems, and a product handling system 54 is disposed on the downstream side of the presses and the transfer systems. The product handling system 54 includes a product discharge shooter 55 and a stacker 56. The transfer system 30A removes a workpiece from the material feeder 51, and transfers the workpiece to the press 10A. Each transfer system (30B, . . . , and 30N) transfers the workpiece from the upstream-side press (e.g., press 10A) to the downstream-side press (e.g., press 10B). The transfer system 30N+1 transfers the workpiece to the product handling system 54. The workpieces are transferred by the product discharge shooter 55 in the direction X either sequentially or intermittently, and stacked in the stacker 56.

As illustrated in FIG. 2, the press 10A is a servo press that is configured so that a slide 12 can be moved upward and downward according to a preset tree press motion by rotating a crank shaft provided in a crown 11 using a servomotor. An upper die 13A is attached to the lower side of the slide 12, and a lower die 14A is attached to the upper side of a bed (or bolster) 15. Note that reference numeral 17 indicates a column. Each press presses the workpiece that has been pressed by and transferred from the preceding press, and transfers the workpiece to the subsequent press.

The transfer system 30B is driven using a servomotor, and includes a transfer mechanism section 32 attached to a main body 31, a transfer arm (not illustrated in FIG. 2), a suction head 33 (i.e., transfer member), and a vacuum cup 34. The transfer system 30B can transfer the workpiece in the direction X according to a preset transfer motion. The transfer arm is a multi-joint/limb-swinging transfer arm, and can always hold the suction head 33 horizontally. More specifically, the transfer mechanism section 32 can move the suction head 33 to the upstream-side press 10A and the downstream-side press 10B around, a position Z illustrated in FIG. 2 while swinging the transfer arm.

The transfer system 30B illustrated in FIG. 2 moves the suction head 33 to the press 10A (TR1) when the slide 12 of the upstream-side press 10A moves upward, removes the workpiece from the lower die 14A using the vacuum cup 34, and returns the suction head 33 to the transfer intermediate position Z (TR2). The transfer system 30B moves the workpiece to a workpiece release position Prr (see FIG. 2) by moving the suction head 33 (TR3), and delivers the workpiece to the lower die 14B before the slide 12 of the downstream-side press 10B moves downward to the press region Aprs (see FIG. 4). The transfer system 30B then immediately moves the suction head 33 to the transfer intermediate position Z (TR4). The operation that returns the suction head 33 to the transfer intermediate position Z along the path indicated by TR4 is hereinafter referred to as "return transfer".

The vacuum cup 34 is connected to a vacuum generation system (not illustrated in FIG. 2) that includes a compressor, an accumulator, and the like. A plurality of (e.g., eight) vacuum cups 34 sufficient to stably hold the workpiece in a state in which a given negative pressure is generated, are attached to the suction head 33.

Note that the configuration and the structure of the transfer system are not limited thereto. The suction head 33 (i.e., transfer member) need not necessarily have a vacuuming structure as long as the suction head 33 can hold and release the workpiece. For example, the suction head 33 may employ an electromagnetic suction method. The suction head 33 need not necessarily utilize the transfer arm structure. For example, the suction head 33 may utilize a slider structure.

A host controller 60 illustrated in FIG. 2 controls the entire press line, and appropriately and properly drives each element (e.g., system). The host controller 60 includes a control section 65 that includes an oscillation circuit, a CPU, and the like, a nonvolatile memory 66 that stores various programs and fixed data, a memory 67 that temporarily stores an execution program and running data for implementing high-speed, processing and the like, and an interface 68.

Press controllers 21A and 21B and a transfer controller 41B (sub-controllers) are configured, in the same manner as the host controller 60. More specifically, each of the press controllers 21A and 21B includes a control section 25 that includes an oscillation circuit, a CPU, and the like, a nonvolatile memory 26, a memory 27, and an interface 28. The transfer controller 41B includes a control section 45 that includes an oscillation circuit, a CPU, and the like, a nonvolatile memory 46, a memory 47, and an interface 48. The tandem press line according to one embodiment of the invention includes a plurality of controllers that are configured in the same manner as the press controllers 21A and 21B, and respectively control the plurality of presses. The tandem press line according to one embodiment of the invention also includes a plurality of controllers that are configured in the same manner as the transfer controller 41B, and respectively control the plurality of transfer systems. When the number of press controllers and the number of transfer controllers are small, the press controllers and the transfer controllers may be integrated in the host controller 60.

A display-operation panel 70 includes a display section 72 and an operation section 74. The display-operation panel 70 allows the operator to input, set, and change data (e.g., position data and parameter) using the operation section 74, and allows the operator to confirm input data and monitor the operation state via the display section 72, for example. The display section 72 may be a touch panel display that also functions as part or the entirety of the operation section 74.

The line master control signal Sm that is generated by and output from the host controller 60 is a control signal for controlling the entire press line, and efficiently, smoothly, and stably driving each line element (system) (e.g., 51, 10A, 10B, 10N, 30A, 30B, 30N, 30N+1, and 54 illustrated in FIG. 1). In one embodiment of the invention, the line master control signal Sm is a combination of a phase signal, a start/stop timing signal for each line element (system), and the like. A time signal, a crank angle signal, a step number signal, or the like may be used as the phase signal. In one embodiment of the invention, a time signal is used as the phase signal (see the horizontal axis in FIG. 4), and the minimum resolution of the time signal is 1 ms, for example. The start/stop timing signal indicates a preset time.

A line master control signal generation means includes the nonvolatile memory 66 that stores a signal generation control program, and the control section 65 that executes the signal generation control program. The line master control signal generation means generates the line master control signal using various types of data and parameters input from the operation section 74. The line master control signal generation process and the details of the line master control signal are displayed on the display section 72. The line master control signal Sm thus generated is stored in the nonvolatile memory 66.

Figure 4:
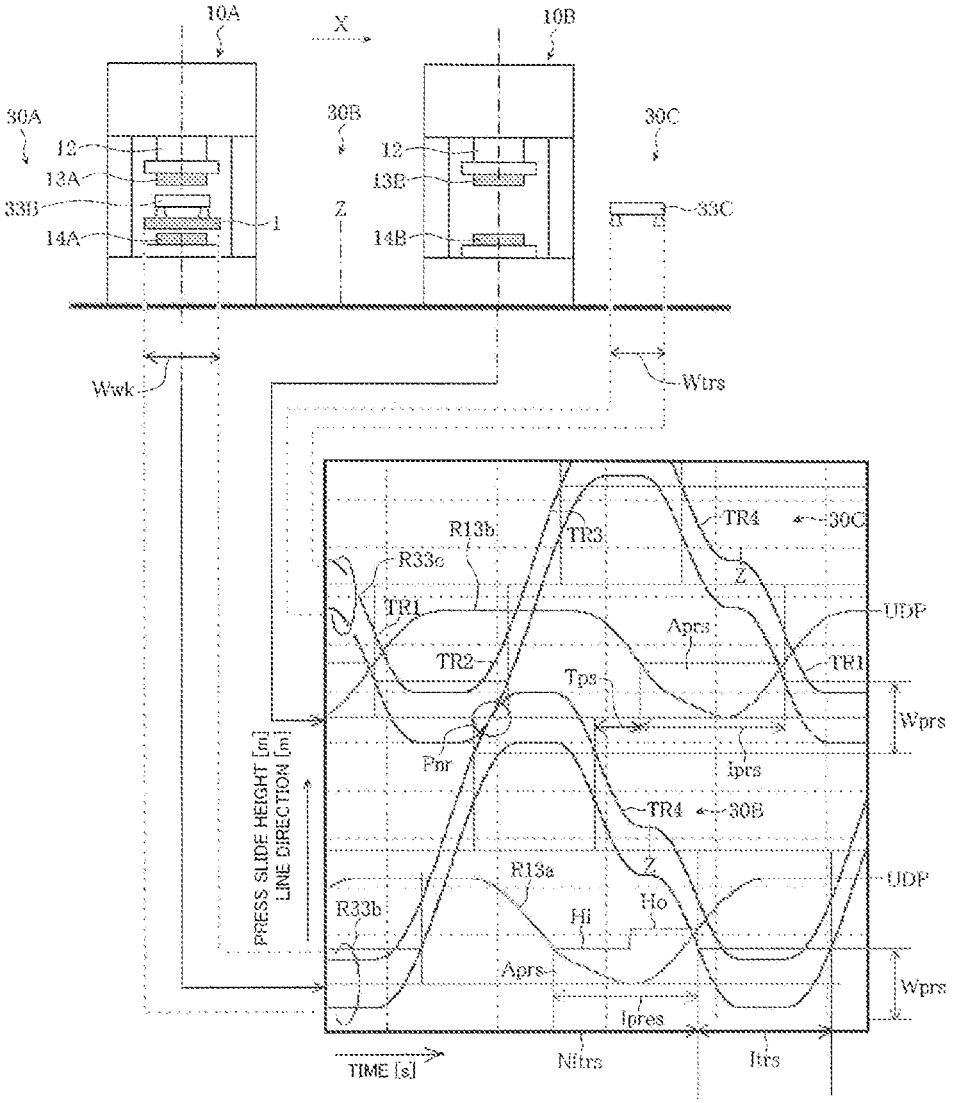
FIG. 4 is a timing chart illustrating a press motion and a transfer motion according to one embodiment of the invention.

The line master control signal Sm may be generated by an arbitrary method. In one embodiment of the invention, a press motion (time—slide height) that is optimum for each press is determined. For example, the press motion of the press 10A illustrated in FIG. 4 is a lowest point path (press motion R13*a*) of the upper die 13A, and the press motion of the press 10B illustrated, in FIG. 4 is a lowest point path (press motion R13*b*) of the upper die 13B.

Specifically, the press motions R13*a* and R13*b* specified by the phase signal and the parameters (e.g., slide position, slide speed, press region, and upper dead point (UDP)) are generated by operating an individual press control signal generation means that includes the nonvolatile memory 66 and the control section 65. The individual press control signal Sp thus generated is stored in the nonvolatile memory 66.

A transfer motion (time—position of suction head) that is optimum for each transfer system is then determined. The transfer motion of the transfer system 30B illustrated in FIGS. 2 and 4 includes a pickup path TR1 of the suction head 33 to the upstream-side press 10A, a return path TR2 of the suction head 33 from the upstream-side press 10A, a delivery path TR3 of the suction head 33 to the downstream-side press 10B, and a return transfer path (return path) TR4 of the suction head 33 from the downstream-side press 10B.

Specifically, transfer motions R33*b* and R33*c* specified by the phase signal and the parameters (e.g., position of suction head, transfer speed, workpiece release position, and transfer intermediate position Z) are generated by operating an individual transfer control signal generation means that includes the nonvolatile memory 66 and the control section 65. The individual transfer control signal St thus generated is stored in the nonvolatile memory 66.

In FIG. 4, the transfer motions R33*b* and R33*c* are indicated by doublet lines, differing from the press motions R13*b* and R13*a*. This is because whether or not interference occurs must be determined using a material transfer width Wwk when the suction head 33 illustrated in FIG. 4 holds a workpiece 1, and a transfer system width Wtrs when the suction head 33 does not hold the workpiece 1. Note that a press width Wprs does not change.

There is no point in generating the line master control signal Sm by merely arranging the press motions R13*a* and R13*b* and the transfer motions R33*b* and R33*c* in the phase direction. Specifically, the line master control signal Sm must be generated so that interference between the elements (e.g., slide 12 and workpiece 1) of the press and the elements (e.g., suction head 33 and workpiece 1) of the transfer system can be reliably prevented. In order to improve the productivity of the press line, it is necessary to sufficiently take account of an increase in operation speed, a reduction in interference determination time, and prompt generation of the line master control signal Sm that reliably prevents interference.

When the elements of the press and the elements of the transfer system are complex, it may be necessary to check the relative positional relationship at several thousand points. When the shape of the workpiece 1 is complex, the number of points for which the relative positional relationship must be checked increases. Specifically, when the distance between each element of the press and each element of the transfer system is set to a minimum value (e.g., several millimeters) that prevents interference in order to increase the operation speed, it takes time to generate each press motion, each transfer motion, and the line master control signal Sm since the number of points for which the relative positional relationship must be checked is large. This may result in a decrease in productivity.

Figure 3:
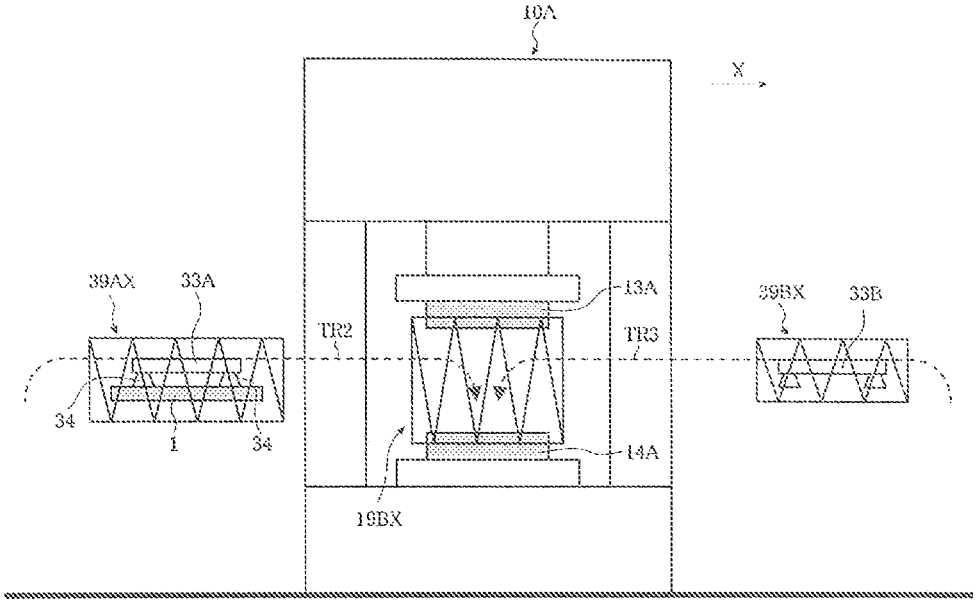
FIG. 3 is a diagram illustrating a measure for preventing interference between a press and a transfer system according to one embodiment of the invention.

The above problem can be solved by utilizing a press-side interference box 19BX that includes the upper die 13A and the lower die 14A (i.e., elements of the press), a transfer-side interference box 39AX that includes the workpiece 1 and the suction head 33A (i.e., elements of the transfer system when the workpiece 1 is held), and a transfer-side interference box 39BX that includes the suction head 33B (i.e., an element of the transfer system when the workpiece 1 is not held) (see FIG. 3). Specifically, whether or not interference occurs is automatically and quickly checked by utilizing the interference boxes that are simplified for easily determining the relative positional involvement state of the elements, and the line master control signal Sm that reliably prevents interference is promptly generated. This makes it possible to significantly improve the overall productivity (i.e., tangible productivity) including the actual operation time and the time required to generate the line master control signal Sm and the like.

The transfer motion R33*b* of the transfer system 30B disposed between the press 10A and the press 10B is generated so that the suction head 33 does not enter the press region Aprs when the slide 12 of the press 10B is positioned within the press region Aprs (i.e., press interference region Iprs). Specifically, the suction head 33 remains within a transfer system interference escape region NItrs. The suction head 33 enters the press width Wprs (hereinafter may be referred to as "transfer system interference region Itrs") only when the slide 12 is positioned above a carry-in upper-side height Hi and a carry-out upper-side height Ho (see FIG. 4). Therefore, interference does not occur.

The transfer motion R33*c* of the transfer system 30C disposed on the downstream side of the press 10B is generated so that the suction head. 33 does not enter the press region Aprs when the slide 12 of the press 10B is positioned within the press region Aprs (i.e., press interference region Iprs). The suction head 33 enters the press width Wprs (hereinafter may be referred to as "transfer system interference region Itrs") only when the slide 12 is positioned above the press region Aprs. Therefore, interference does not occur.

The line master control signal generation means generates the line master control signal Sm so that the press motion and the transfer motion are linked to an identical master phase signal. In FIG. 4, when the transfer system 30C removes the workpiece 1 from the upstream-side press 10B, and transfers the workpiece 1 to the downstream-side transfer intermediate position Z (TR2), the transfer system 30B transfers the workpiece 1 to the press 10B (TR3).

In this case, the transfer system 30B and the transfer system 30C are positioned closest to each other at a position Pnr. Specifically, the master phase signal is generated as the line master control signal Sm so that wastage of time is minimized. In this case, it is also necessary to provide a line control allowance time Tps. This is effective for correcting an error caused, by the actual operation, and the like.

Figure 5:
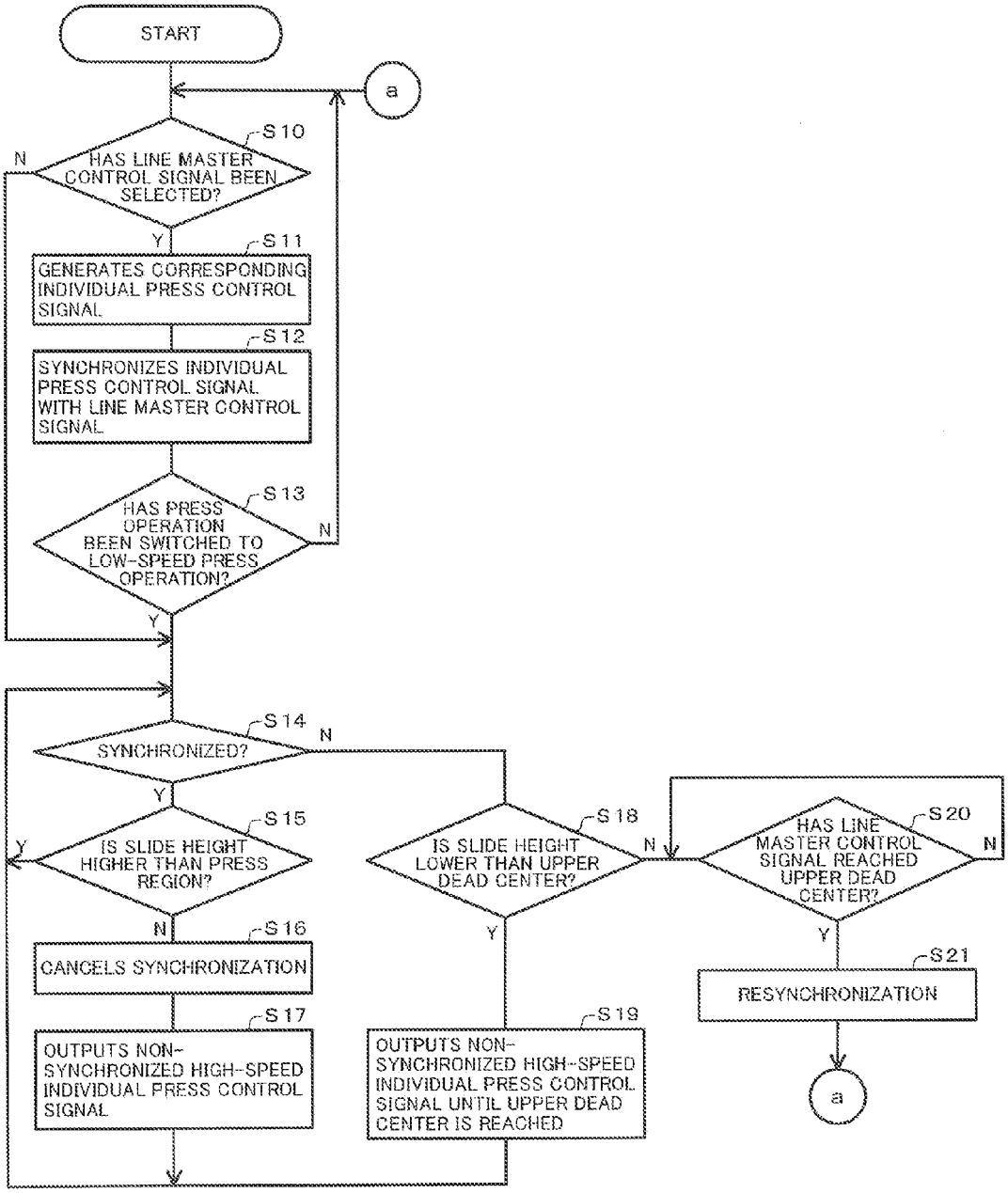
FIG. 5 is a flowchart illustrating a press-side operation speed change operation according to one embodiment of the invention.
Figure 6:
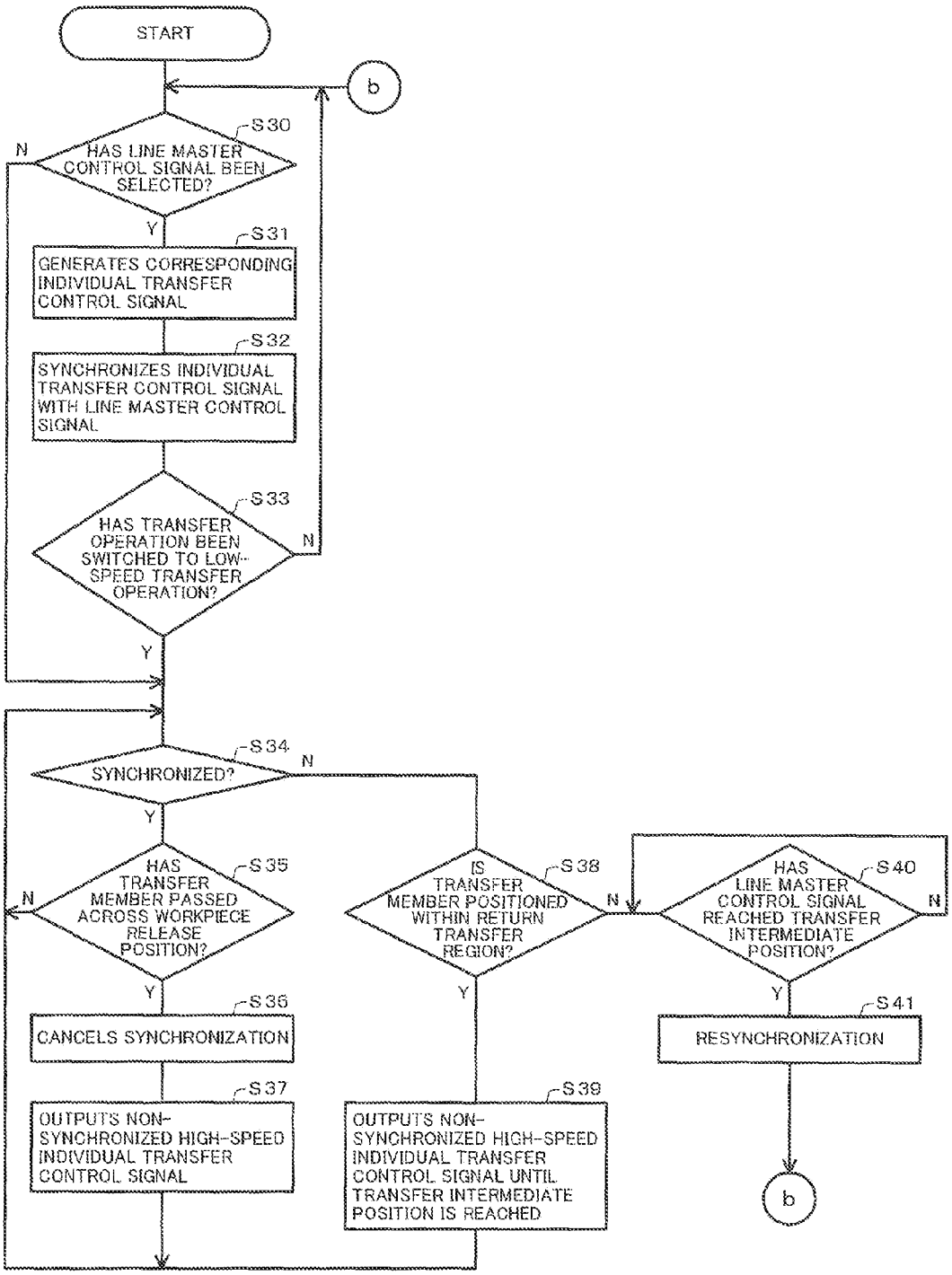
FIG. 6 is a flowchart illustrating a transfer system-side operation speed change operation according to one embodiment of the invention.

FIGS. 5 and 6 illustrate the operations of the host controller 60, each press controller 21, and each transfer controller 41. FIG. 5 illustrates the operation (S10 to S13) of the host controller 60 and the operation (S14 to S21) of each press controller 21. FIG. 6 illustrates the operation (S30 to S33) of the host controller 60 and the operation (S34 to S41) of each transfer controller 41. FIGS. 5 and 6 are drawn for convenience of description. Note that "S" indicates "STEP", "Y" indicates "YES", and "N" indicates "NO".

When the operator has selected the line master control signal Sm using the display-operation panel 70 illustrated in FIG. 2 (YES in S10 (see FIG. 5)) (the following description is given on the assumption that the operator has selected the high-speed line master control signal Smh as the line master control signal Sm), the individual press control signal generation output means that includes the nonvolatile memory 66 and the control section 65 generates the high-speed individual press control signal Sph that corresponds to the high-speed line master control signal Smh (S11). Since the high-speed individual press control signal Sph has been generated and stored in advance, the high-speed individual press control signal Sph for each press that corresponds to the selected, high-speed line master control signal Smh is read from the nonvolatile memory 66.

The high-speed individual press control signal Sph is then output to each press. A storage control means of each press controller 21 that includes the control section 25 and the nonvolatile memory 26 or the memory 27 stores the high-speed individual press control signal Sph in the nonvolatile memory 26 or the memory 27.

The individual transfer control signal generation means generates the high-speed individual transfer control signal Sth that corresponds to the high-speed line master control signal Smh (YES in S30 and S31). Since the high-speed individual transfer control signal Sth has been generated and stored in advance, the high-speed individual transfer control signal Sth for each transfer system that corresponds to the selected, high-speed line master control signal Smh is read from the nonvolatile memory 66.

The high-speed individual transfer control signal Sth is then output to each transfer system. A storage control means of each transfer controller that includes the control section 45 and the nonvolatile memory 46 stores the high-speed individual transfer control signal Sth in the nonvolatile memory 46 or the memory 47.

When the operator has issued an operation start instruction using the display-operation panel 70, a synchronized operation instruction control means that includes the nonvolatile memory 66 and the control section 65 outputs the high-speed, line master control signal Smh (i.e., synchronized operation instruction) to each press controller 21 that is set in a standby state (S12). The synchronized operation instruction control means also outputs the high-speed line master control signal Smh (i.e., synchronized operation instruction) to each transfer controller that is set in a standby state (S32).

Each press controller 21 subjects the corresponding press to synchronized high-speed press control using the high-speed, individual press control signal Sph that corresponds to and is synchronized with the high-speed line master control signal Smh. Each transfer controller subjects the corresponding transfer system to synchronized high-speed, transfer control using the high-speed individual transfer control signal Sth that corresponds to and is synchronized with the high-speed line master control signal Smh. Therefore, a pressed product (press-formed product) can be produced smoothly and stably without causing interference (see FIG. 4).

An abnormality may occur during a continuous operation of the press line. The cause of such an abnormality may generally be eliminated without stopping the press line. Moreover, the cause of an abnormality that can be easily eliminated can generally be eliminated by operating the press line at low speed. For example, when the workpiece 1 is held in an unstable state since the negative pressure of each vacuum cup 34 is low or differs from each other, the problem can be solved, by waiting for the internal pressure of the accumulator to be stabilized. When an unintended number of products remain in the product discharge shooter 55, the problem can be solved by increasing the discharge interval from the press. This also applies to the case where an unintended number of products are stacked in the stacker 56.

When an abnormality has occurred, the operator can select the low-speed line master control signal Sml using the display-operation panel 70 (YES in S10 (see FIG. 5)). The individual press control signal generation output means then generates the low-speed individual press control signal Spl for each press that corresponds to the low-speed line master control signal Sml (S11).

Note that the tandem press line may be configured so that one low-speed individual press control signal Spl among a plurality of low-speed individual press control signals Spl can be selected corresponding to the low-speed line master control signal Sml. This also applies to the low-speed individual transfer control signal Stl.

The low-speed individual press control signal Spl is output to each press. The storage control means of each press controller 21 stores the low-speed individual press control signal Spl in the nonvolatile memory 26 or the memory 27 in the same manner as the high-speed individual press control signal Sph.

The high-speed individual press control signal Sph and the low-speed individual press control signal Spl are thus stored in the nonvolatile memory 26 or the memory 27. Note that all of the individual press control signals Sp may be stored in the nonvolatile memory 26 in advance, and the individual press control signal Sp that corresponds to the selected line master control signal Sm may be specified. The host controller 60 and each press controller 21 may be formed integrally so that the individual press control signal Sp can be shared.

Two non-synchronized high-speed, individual press control signals Sphn (Sphnp and Sphnq) are stored, in the nonvolatile memory 26. The non-synchronized high-speed individual press control signal Sphnp is an extracted high-speed individual press control signal obtained by extracting a specific range of the high-speed line master control signal Smh including the press region. The non-synchronized high-speed individual press control signal Sphnq is an accuracy-maintaining high-speed individual press control signal that is distinct from the high-speed individual press control signal Sph that corresponds to the high-speed line master control signal Smh. A non-synchronized high-speed press operation (S17 and S19 in FIG. 5) can be implemented using an arbitrary non-synchronized high-speed individual press control signal Sphn.

The individual transfer control signal generation output means generates the low-speed individual transfer control signal Stl that corresponds to the low-speed, line master control signal Sml (YES in S30 and S31). The low-speed individual transfer control signal Stl thus generated, is output to each transfer system. The storage control means of each transfer controller stores the low-speed individual transfer control signal Stl in the nonvolatile memory 46 or the memory 47 in the same manner as the high-speed individual transfer control signal Sth.

The high-speed individual transfer control signal Sth and the low-speed individual transfer control signal Stl are thus stored in the nonvolatile memory 46 or the memory 47. Note that ail of the individual transfer control signals St may be stored in the nonvolatile memory 46 in advance, and the individual transfer control signal St that corresponds to the selected line master control signal Sm may be specified. The host controller 60 and each transfer controller may be formed integrally so that the individual transfer control signal St can be shared.

Two non-synchronized high-speed individual transfer control signals Sthn (Sthnp and Sthnq) are stored in the nonvolatile memory 46. The non-synchronized high-speed individual transfer control signal Sthnp is an extracted high-speed individual transfer control signal obtained, by extracting a specific range of the high-speed line master control signal Smh including the return transfer region. The non-synchronized high-speed individual transfer control signal Sthnq is an escape-exclusive high-speed individual transfer control signal that is distinct from the high-speed individual transfer control signal Sth that corresponds to the high-speed line master control signal Smh. Since the suction head 33 does not suck the workpiece 1 in the return transfer region, the load due to the transfer motion is low. Therefore, the escape-exclusive high-speed transfer speed may be increased as compared with the transfer speed when using the high-speed individual transfer control signal Sth. A non-synchronized high-speed transfer operation (S37 and S39 in FIG. 6) can be implemented using an arbitrary non-synchronized high-speed individual transfer control signal Sthn.

When the operator has issued an operation start instruction using the display-operation panel 70, the synchronized operation instruction control means outputs the low-speed line master control signal Sml (i.e., synchronized operation instruction) to each press controller 21 that is in a standby state (S12). The synchronized operation instruction control means also outputs the low-speed line master control signal Sml (i.e., synchronized operation instruction) to each transfer controller that is set in a standby state (S32).

Each press controller 21 then subjects the corresponding press to synchronized low-speed press control using the low-speed individual press control signal Spl that corresponds to and is synchronized with the low-speed line master control signal Sml. Each transfer controller subjects the corresponding transfer system to synchronized low-speed transfer control using the low-speed individual transfer control signal Stl that corresponds to and is synchronized with the low-speed line master control signal Sml.

Specifically, since the line can be operated at low speed, the negative pressure of the vacuum cup 34 can be stabilized, or the workpiece 1 can be held stably and reliably. When an unintended number of products remain in the product discharge shooter 55, the operator can remove some of the products, or replace the stacker 56. Specifically, the cause of an abnormality can be eliminated.

The operation may be automatically switched from the high-speed operation to the low-speed operation. The operator may select whether to automatically or manually switch the operation.

Specifically, the tandem press line is configured so that whether or not the involvement state of the element (e.g., vacuum cup 34) of the transfer system and the workpiece 1 predicts that it is difficult to maintain continuous operation can be detected, and the line master control signal can be automatically switched from the high-speed line master control signal Smh to the low-speed line master control signal Sml when it has been detected, that it is difficult to maintain continuous operation. For example, the line master control signal is automatically switched from the high-speed line master control signal Smh to the low-speed, line master control signal Sml when the internal pressure of the accumulator has been detected to be equal to or less than a preset value. It is determined that the line master control signal Sm has been selected (switched) (YES) in the step S10 or S30 on condition that the automatic switch function has been selected.

It is determined that the line master control signal Sm has been selected (switched) (YES) in the step S10 or S30 on condition that it has been determined that a number of products remain in the product handling system 54 (see FIG. 1) that is disposed on the downstream side of the press line (e.g., when a photoelectric sensor 57 (see FIG. 2) has detected that it is difficult to maintain continuous operation), and the automatic switch function has been selected.

Note that a plurality of photoelectric sensors 57 may be provided, and a decrease in speed may differ between a case where it has been detected that it is difficult to maintain continuous operation since a number of products remain in the product discharge shooter 55 and a case where it has been detected that it is difficult to maintain continuous operation since a number of products remain in the stacker 56. Specifically, one low-speed line master control signal Sml may be automatically selected, from a plurality of low-speed line master control signals Sml that corresponds to one high-speed line master control signal Smh corresponding to the degree of difficulty in maintaining continuous operation. Alternatively, the low-speed line master control signal Sml may be automatically selected corresponding to the degree of difficulty in maintaining continuous operation in a specific area (e.g., product discharge shooter 55 and/or stacker 56) of the press line.

When the press operation has been switched from the high-speed press operation to the low-speed press operation in order to eliminate the abnormality, the press motion of each press changes regardless of whether manual selection or automatic selection is used. FIG. 4 illustrates the press motion of the presses 10A and 10B during the high-speed press operation. The press motion of the presses 10A and 10B during the low-speed press operation is wider in the horizontal axis direction as compared with the press motion during the high-speed press operation. The slide 12 moves downward at low speed within the press region Aprs during the low-speed press operation.

When the press operation has been switched from the synchronized high-speed press operation to the synchronized low-speed press operation, the relative speeds of the workpiece 1 and the dies 13 and 14 change in a press that starts to perform a press-forming operation, or is performing a press-forming operation, so that the press-forming accuracy decreases. It is necessary to prevent occurrence of a defective product from the viewpoint of productivity and cost. Occurrence of a defective product reduces the effect of avoiding a situation in which the press operation is stopped due to an abnormality.

The invention is technically configured so that a product can be produced, while maintaining the press-forming accuracy (with the same press-forming accuracy) even after the line (press) speed has been reduced.

As illustrated in FIG. 5, each press controller 21 receives the information (that indicates that the press operation has been switched to the low-speed press operation (S10)) transmitted from the host controller 60 (YES in S13). The information may be a dedicated signal, or the low-speed individual press control signal Spl may be used as the information. As illustrated in FIG. 5, the host controller 60 need, not transmit information that indicates that the press operation has been switched, to the high-speed press operation (S10) to each press controller 21.

When each press controller 21 has received the information that indicates that the press operation has been switched to the low-speed press operation, each press controller 21 determines whether or not a synchronized operation is performed. Specifically, a synchronization determination means that includes the control section 25 and the nonvolatile memory 26 determines whether or not a low-speed press operation is performed using the low-speed, individual press control signal Spl that is synchronized with the phase of the low-speed line master control signal Sml (S14). When it has been determined that a low-speed press operation is performed using the low-speed individual press control signal Spl that is synchronized with the phase of the low-speed line master control signal Sml, a press region determination means that includes the control section 25 and the nonvolatile memory 26 determines whether or not the slide height is higher than the press region Aprs (815). When it has been determined that, the slide height is higher than the press region Aprs (YES in S15), the slide 12 continues the synchronized low-speed press operation.

When the slide height has moved downward to a position equal to or lower than the press region Aprs (NO in S15), a synchronization cancelation control means that includes the control section 25 and the nonvolatile memory 26 cancels the synchronized low-speed press operation (S16). Specifically, the synchronization cancelation control means interrupts the synchronized low-speed, press operation using the low-speed individual press control signal Spl that is synchronized with the phase of the low-speed line master control signal Sml.

A non-synchronized high-speed, press operation control means that includes the control section 25 and the nonvolatile memory 26 outputs the non-synchronized high-speed individual press control signal Sphn (S17) so that the press operation is switched to the non-synchronized high-speed press operation. The non-synchronized high-speed press operation is performed at least when the slide position is within the press region. In one embodiment of the invention, the non-synchronized high-speed press operation is performed until the slide position reaches the upper dead point (press resynchronization point). This facilitates resynchronization.

When the extracted high-speed individual press control signal Sphnp has been selected, the non-synchronized high-speed press operation is performed according to the press motion (extracted high-speed individual press control signal Sphnp) within the same range as the specific range of the high-speed line master control signal Smh including the press region. In this case, the high-speed press operation phase signal is generated by utilizing a pulse signal of the oscillation circuit included in the control section 25, and is equal to the master phase signal that forms the high-speed line master control signal Smh. Therefore, the same press-forming accuracy as that before the press operation has been switched, can be maintained.

When the accuracy-maintaining high-speed individual press control signal Sphnq has been selected, the non-synchronized high-speed press operation is performed according to the press motion specified by the accuracy-maintaining high-speed individual press control signal Sphnq that has been generated and stored. In this case, the partial press motion including the high-speed press operation phase signal can be arbitrarily determined. This improves the degree of freedom of selection. Since the accuracy-maintaining high-speed individual press control signal Sphnq that has been arbitrarily determined by the press controller 21 is independent of the high-speed, line master control signal Smh, but can achieve a press-forming accuracy equal to or higher than that achieved when implementing the press operation in synchronization with the high-speed line master control signal Smh, the accuracy can be reliably maintained.

When it has been determined that a low-speed press operation is not performed using the low-speed individual press control signal Spl that is synchronized with the phase of the low-speed line master control signal Sml (NO in S14), a press resynchronization point arrival determination means that includes the control section 25 and the nonvolatile memory 26 determines whether or not the height of the slide 12 has reached the upper dead point (press resynchronization point) during the non-synchronized high-speed press operation (S18). When it has been determined that the height of the slide 12 has not reached the upper dead point (UDP) (YES in S18), the non-synchronized high-speed press operation using the non-synchronized high-speed, individual press control signal Sphn is continuously performed (S19). The master phase signal of the low-speed individual press control signal Spl (i.e., low-speed line master control signal Sml) also progresses during this period. The process can be visually confirmed on the display section 72.

When it has been determined that the height of the slide 12 has reached the upper dead point (UDP) (NO in S18), a non-synchronized high-speed press control stop control means that includes the control section 25 and the nonvolatile memory 26 stops the non-synchronized high-speed press operation. Specifically, the phase signal is stopped when the non-synchronized high-speed press phase of the non-synchronized high-speed, individual press control signal Sphn has become equal to the phase that indicates the upper dead point.

When the master phase of the low-speed line master control signal Sml and the low-speed individual press control signal Spl has become equal to the non-synchronized high-speed press phase, an individual press control signal resynchronization control means that includes the control section 25 and the nonvolatile memory 26 switches the individual press control signal from the non-synchronized high-speed individual press control signal Sphn to the low-speed individual press control signal Spl (i.e., implements resynchronization) (ST21). The press operation is thus returned to the synchronized low-speed press operation (NO in S10 and ST14). This makes it possible to investigate and eliminate the cause of the abnormality.

When the cause of the line abnormality has been eliminated during the synchronized low-speed press operation, the operator selectively switches the line master control signal to the high-speed, line master control signal Smh using the display-operation panel 70 (YES in S10 (FIG. 5)). The line master control signal may be automatically switched to the high-speed line master control signal Smh by utilizing a non-detection state signal output from the photoelectric sensor 57 or the like.

The individual press control signal generation output means then generates the high-speed individual press control signal Sph for each press that corresponds to the high-speed line master control signal Smh. The high-speed individual press control signal Sph is output to each press (S11 and S12). Each press controller implements a synchronized high-speed press operation. The process does not proceed to the step S14.

When the previous high-speed line master control signal Smh has been selected, it suffices that the host controller 60 transmit only the master phase signal since the high-speed individual press control signal Sph is stored in each press controller.

It is preferable to more reliably prevent interference while main taming the press-forming accuracy. Therefore, each transfer system performs a non-synchronized high-speed return transfer operation even during the low-speed transfer operation that is synchronized with the low-speed line master control signal Sml.

As illustrated in FIG. 6, each transfer controller receives the information (that indicates that the transfer operation has been switched to the low-speed transfer operation (S30)) transmitted from the host controller 60 (YES in S33). The information may be a dedicated signal, or the low-speed individual transfer control signal Stl may be used as the information. As illustrated in FIG. 6, the host controller 60 need not transmit information that indicates that the transfer operation has been switched to the high-speed transfer operation (S30) to each transfer controller.

When each transfer controller has received the information that indicates that the transfer operation has been switched to the low-speed, transfer operation, each transfer controller determines whether or not a synchronized operation is performed. Specifically, a synchronization determination means that includes the control section 45 and the nonvolatile memory 46 determines whether or not a low-speed transfer operation is performed using the low-speed individual transfer control signal Stl that is synchronized with the phase of the low-speed line master control signal Sml (S34). When a low-speed transfer operation is performed using the low-speed individual transfer control signal Stl that is synchronized with the phase of the low-speed line master control signal Sml, a return transfer region determination means that, includes the control section 45 and the nonvolatile memory 46 determines whether or not the suction head 33 is positioned within the return transfer region (S35). In the step S35 in FIG. 6, the return transfer region determination means determines whether or not the suction head 33 is positioned within the return transfer region based on whether or not the suction head 33 has passed across the workpiece release position Prr. Specifically, the return transfer region determination means determines whether or not the workpiece 1 has been delivered to the press. When it has been determined that the suction head 33 has not passed across the workpiece release position Prr (NO in S35), the transfer system continues the synchronized low-speed transfer operation.

When it has been determined that the suction head 33 has passed across the workpiece release position Prr (YES in S35), a synchronization cancelation control means cancels synchronization (S36). Specifically, the synchronization cancelation control means interrupts the synchronized low-speed transfer operation using the low-speed individual transfer control signal Stl that is synchronized with the phase of the low-speed line master control signal Sml.

A non-synchronized high-speed transfer operation control means outputs the non-synchronized high-speed individual transfer control signal Sthn (S37) so that the transfer operation is switched to the non-synchronized high-speed transfer operation. The non-synchronized high-speed transfer operation is performed at least when the transfer member is positioned within the return transfer region. In one embodiment of the invention, the non-synchronized high-speed transfer operation is performed until the transfer member reaches the transfer intermediate position Z (transfer resynchronization point). This facilitates resynchronization.

When the extracted high-speed individual transfer control signal Sthnp has been selected, the non-synchronized high-speed transfer operation is performed according to the transfer motion within the same range as the specific range of the high-speed, line master control signal Smh including the return transfer region. In this case, the high-speed transfer operation phase signal is generated by utilizing a pulse signal of the oscillation circuit included in the control section 45, and is equal to the master phase signal that forms the high-speed line master control signal Smh. This makes it possible to reliably prevent interference between the transfer system and the press even if the workpieces 1 differ in shape, for example.

When the escape-exclusive high-speed individual transfer control signal Sthnq has been selected, the non-synchronized high-speed transfer operation is performed according to the transfer motion specified by the escape-exclusive high-speed individual transfer control signal Sthnq that has been generated and stored. In this case, the partial transfer motion including the high-speed transfer operation phase signal can be arbitrarily determined. This improves the degree of freedom of selection. The escape-exclusive high-speed individual transfer control signal Sthnq that has been arbitrarily determined by the transfer controller 41 is independent of the high-speed line master control signal Smh, but can achieve an interference prevention effect equal to or better than that achieved, when implementing the transfer operation in synchronization with the high-speed, line master control signal Smh.

When it has been determined that a low-speed transfer operation is performed using the low-speed individual transfer control signal Stl that is synchronized with the phase of the low-speed line master control signal Sml (NO in S34), a transfer resynchronization point arrival determination means determines whether or not the suction head 33 has passed across the workpiece release position Prr (i.e., is positioned within the return transfer region) during the non-synchronized high-speed transfer operation (S38). When it has been determined that the suction head 33 is positioned within the return transfer region (YES in S38), the transfer system continues the non-synchronized high-speed transfer operation using the non-synchronized high-speed individual transfer control signal Sthn (S39). The phase signal of the low-speed individual transfer control signal Stl (i.e., low-speed line master control signal Sml) also progresses during this period. The process can be visually confirmed on the display section 72.

When the suction head 33 has reached the transfer intermediate position Z, it is determined that the suction head 33 is not positioned within the return transfer region (NO in S38), and a non-synchronized high-speed transfer control stop control means stops the non-synchronized high-speed transfer operation. Specifically, the progress of the phase of the non-synchronized high-speed individual transfer control signal Sthn stops.

When the master phase of the low-speed line master control signal Sml (low-speed individual transfer control signal Stl) has become equal to the non-synchronized high-speed transfer phase, an individual transfer control signal resynchronization control means switches the individual transfer control signal from the non-synchronized high-speed individual transfer control signal Sthn to the low-speed individual transfer control signal Stl (i.e., implements resynchronization) (ST41). The transfer operation is thus returned to the synchronized low-speed transfer operation (NO in S30 and ST34).

When the cause of the line abnormality has been eliminated during the synchronized low-speed transfer operation, the operator selectively switches the line master control signal to the high-speed, line master control signal Smh using the display-operation panel 70 (YES in S30 (FIG. 6)). The line master control signal may be automatically switched, to the high-speed line master control signal Smh by utilizing a non-detection state signal output from the photoelectric sensor 57 or the like.

The individual transfer control signal generation output means then generates the high-speed individual transfer control signal Sth for each transfer system that corresponds to the high-speed line master control signal Smh. The high-speed individual transfer control signal Sth is output to each transfer system (S31 and S32). Each transfer controller 41 implements a synchronized high-speed transfer operation. The process does not proceed to the step S34.

When the previous high-speed line master control signal Smh has been selected, it suffices that the host controller 60 transmit only the master phase signal since the high-speed individual press control signal Sph is stored in each press controller 21.

The effects (advantages) and the operations according to the above embodiments are described below.

Synchronized High-Speed Operation

The line master control signal Sm (e.g., high-speed line master control signal Smh) that is optimum for producing a product is selected using the operation section 74 to instruct the line operation. Each press controller 21 outputs the high-speed individual press control signal Sph, and each press performs the press operation in synchronization with the master phase of the high-speed line master control signal Smh (S10 to S12 in FIG. 5). Each transfer controller outputs the high-speed individual transfer control signal Sth, and each transfer system performs the transfer operation in synchronization with the master phase of the high-speed line master control signal Smh (S30 to 32 in FIG. 6).

Synchronized Low-Speed Operation

For example, when a number of products remain in the product handling system 54, the photoelectric sensor 57 detects that it is difficult to maintain continuous operation, and the line master control signal Sm is switched from the high-speed line master control signal Smh to the low-speed line master control signal Sml. Each press controller 21 outputs the low-speed individual press control signal Spl, and each press performs the synchronized low-speed press operation in synchronization with the master phase of the low-speed line master control signal Sml (S10 to S12 in FIG. 5). Each transfer controller outputs the low-speed individual transfer control signal Stl, and each transfer system performs the synchronized low-speed transfer operation in synchronization with the master phase of the low-speed line master control signal Sml (S30 to 32 in FIG. 6). This also applies to the case of manually switching the line master control signal Sm. The information that indicates that the operation has been switched to the low-speed operation is transmitted to each press controller 21 and each transfer controller (S13 and S33).

Non-Synchronized High-Speed Operation

Each press controller 21 cancels synchronization when the slide height has entered the press region, and outputs the non-synchronized high-speed individual press control signal Sphn. Each press then performs the non-synchronized high-speed press operation (S14 to S19). This makes it possible to maintain the product accuracy. The master phase of the low-speed individual press control signal Spl (i.e., low-speed line master control signal Sml) progresses at low speed. Each transfer controller cancels synchronization when the suction head 33 has entered the return transfer region, and outputs the non-synchronized high-speed individual transfer control signal Sthn. Each transfer system then performs the non-synchronized high-speed transfer operation (S34 to S39). This makes it possible to more reliably prevent interference. The phase of the low-speed individual transfer control signal Stl (i.e., low-speed line master control signal Sml) progresses at low speed.

Resynchronization

When the slide 12 has reached the upper dead point (UDP), the press operation is resynchronized (S18 to S21). Specifically, the press operation is switched from the non-synchronized high-speed press operation to the synchronized low-speed press operation. The products that remain in the product discharge shooter 55 or the like can be appropriately adjusted during this period, for example. The press operation is switched once every cycle. When the suction head 33 has reached the transfer intermediate position Z, the transfer operation is resynchronized (S38 to S41). Specifically, the transfer operation is switched from the non-synchronized high-speed transfer operation to the synchronized low-speed transfer operation. This is in order to avoid interference. The transfer operation is switched, once every cycle.

Return to Synchronized High-Speed Operation

When it has become possible to perform continuous operation using the product handling system 54, the photoelectric sensor 57 is turned OFF, and the line master control signal Sm is switched from the low-speed line master control signal Sml to the high-speed line master control signal Smh. Each press controller 21 outputs the high-speed individual press control signal Sph, and each press performs the synchronized high-speed press operation in synchronization with the master phase signal of the high-speed line master control signal Smh (S10 to S12 in FIG. 5). Each transfer controller outputs the high-speed individual transfer control signal Sth, and each transfer system performs the synchronized high-speed transfer operation in synchronization with the phase signal of the high-speed line master control signal Smh (S30 to 32 in FIG. 6). This also applies to the case of manually switching the line master control signal Sm. In FIGS. 5 and 6, each press controller 21 and each transfer controller are not notified, that the operation has been switched to the high-speed operation. This prevents a situation in which the production is temporarily stopped. This makes it possible to maintain high productivity and high product accuracy.

Since the tandem press line is configured so that each press can be subjected to synchronized low-speed press control when the line master control signal Sm has been switched from the high-speed line master control signal Smh to the low-speed line master control signal Sml, a press for which it has been determined that the slide position is within the press region can be subjected to non-synchronized high-speed press control based on the non-synchronized high-speed individual press control signal Sphn, non-synchronized high-speed press control can be stopped on condition that the slide position has reached the press resynchronization point, resynchronization can be achieved, using the low-speed, individual press control signal Spl instead, of the non-synchronized high-speed individual press control signal Sphn on condition that the low-speed line master control signal Sml has reached the press resynchronization point, and press control can be automatically switched from non-synchronized high-speed press control to synchronized low-speed press control, the press-forming accuracy can be maintained even if the press operation has been switched from the high-speed press operation to the low-speed press operation. Since continuous operation can be performed, without stopping the entire press line, the tangible productivity can be maintained and improved. Moreover, since the high-speed press operation can be resumed after eliminating the cause of an abnormality during continuous operation, tangible productivity can be further improved.

Since the tandem press line is configured so that the line master control signal can be automatically switched from the high-speed line master control signal Smh to the low-speed line master control signal Sml when it has been detected that the involvement state of the product handling system 54 (element) of the press line and the workpiece 1 predicts that it is difficult to maintain continuous operation, the problem can be eliminated during the low-speed press operation. This makes it possible to reliably prevent a situation in which the entire press line is stopped, and maintain productivity.

Since it is detected that it is difficult to maintain continuous operation when a number of products remain in the product handling system 54, the operation can be more reliably and appropriately switched to the low-speed operation.

Since the non-synchronized high-speed, individual press control signal Sphn is generated using the extracted high-speed individual press control signal Sphnp that corresponds to the press motion of the high-speed line master control signal Smh, but is not synchronized with the master phase signal, a signal that corresponds to the high-speed individual press control signal Sph can be effectively utilized. This makes it possible to easily and reliable generate a signal.

Since the non-synchronized high-speed individual press control signal Sphn is generated using the accuracy-maintaining high-speed individual press control signal Sphnq that is distinct from the high-speed individual press control signal Sph that corresponds to the high-speed line master control signal, the degree of freedom of selection of the non-synchronized high-speed individual press control signal is improved, and the signal format can be easily simplified.

Since the extracted high-speed individual press control signal Sphnp and the accuracy-maintaining high-speed individual press control signal Sphnq can be generated as part of the motion within one cycle, the extracted high-speed individual press control signal Sphnp and the accuracy-maintaining high-speed individual press control signal Sphnq can be easily and promptly generated as compared with the case of generating the entire press motion within one cycle.

Since the press resynchronization point is set to the upper dead point (UDP), the press resynchronization point is accurate. Therefore, resynchronization for returning the press operation to the low-speed press operation can be implemented more reliably and stably.

A transfer system for which it has been determined that the transfer member is positioned within the return transfer region during synchronized low-speed transfer control using the low-speed individual transfer control signal Stl can be subjected to non-synchronized high-speed transfer control based on the non-synchronized high-speed individual transfer control signal Sthn, non-synchronized high-speed transfer control can be stopped on condition that the transfer member has reached the transfer intermediate position Z (transfer resynchronization point), resynchronization can be achieved using the low-speed individual transfer control signal Stl instead of the non-synchronized high-speed individual transfer control signal Sthn when the low-speed line master control signal Sml has reached the transfer resynchronization point, and transfer control can be automatically switched from non-synchronized high-speed transfer control to synchronized low-speed transfer control Specifically, since the speed of the return transfer that moves the transfer member away from the press can be increased, interference can be more reliably prevented.

Since the non-synchronized high-speed individual transfer control signal Sthn is generated, using the extracted high-speed individual transfer control signal Sthnp that corresponds to the transfer motion of the high-speed line master control signal Smh, but is not synchronized with the master phase signal, a signal that corresponds to the high-speed individual transfer control signal Sth can be effectively utilized. This makes it possible to easily and reliable generate a signal.

Since the non-synchronized high-speed individual transfer control signal Sthn is generated using the escape-exclusive high-speed individual transfer control signal Sthnq that is distinct from the high-speed individual transfer control signal Sth that corresponds to the high-speed, line master control signal, the degree of freedom of selection of the non-synchronized high-speed individual transfer control signal is improved, and the signal format can be easily simplified.

Since the extracted high-speed individual transfer control signal Sthnp and the escape-exclusive high-speed individual transfer control signal Sthnq can be generated, as part of the motion within one cycle, the extracted high-speed, individual transfer control signal Sthnp and the escape-exclusive high-speed individual transfer control signal Sthnq can be easily and promptly generated as compared, with the case of generating the entire press motion within one cycle.

Since the transfer resynchronization point is set to the transfer intermediate position Z, the transfer resynchronization point is accurate. Therefore, resynchronization for returning the transfer operation to the low-speed, transfer operation can be implemented more reliably and stably.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A tandem press line comprising:

a control system including a controller, the control system being configured to supply a line master control signal, an individual press control signal that corresponds to and is synchronized with the line master control signal and an individual transfer control signal that corresponds to and is synchronized with the line master control signal;

a plurality of presses that perform a synchronized press control for each of the plurality of presses by using the individual press control signal; and a plurality of transfer systems that are alternately disposed with the plurality of presses in a line direction, and perform a synchronized transfer control for each of the plurality of transfer systems by using the individual transfer control signal, wherein the controller is configured to:

perform a synchronized low-speed press control for each of the plurality of presses by using a low-speed individual press control signal that corresponds to and is synchronized with a low-speed line master control signal when the line master control signal has been switched from a high-speed line master control signal to the low-speed line master control signal;

determine whether or not a slide position of each of the plurality of presses under the synchronized low-speed press control is within a press region;

switch the synchronized low-speed press control to a non-synchronized high-speed press control using a non-synchronized high-speed individual press control signal that is not synchronized with the low-speed line master control signal for a press among the plurality of presses having a slide position that has been determined to be within the press region at least during a period in which the slide position is within the press region;

stop the non-synchronized high-speed press control on condition that the slide position under the non-synchronized high-speed press control has reached a press resynchronization point; and switch the non-synchronized high-speed individual press control signal to the low-speed individual press control signal for resynchronization, and automatically switch the non-synchronized high-speed press control that has been stopped to the synchronized low-speed press control on condition that a phase of the low-speed line master control signal has become equal to a phase of the non-synchronized high-speed individual press control signal.

2. The tandem press line according to claim 1, wherein the controller is further configured to:

determine whether or not a relationship between a component of the tandem press line and a workpiece is in a state in which maintaining continuous operation is difficult; and automatically switch the high-speed line master control signal to the low-speed line master control signal when detecting that the relationship is in a state in which maintaining continuous operation is difficult.

3. The tandem press line according to claim 2, wherein:

the component is a product handling unit that is disposed on a downstream side of the tandem press line, and wherein it is determined that the relationship is in the state in which the maintaining continuous operation is difficult when a number of products remain in the product handling unit.

4. The tandem press line according to claim 1, wherein the non-synchronized high-speed individual press control signal is an extracted high-speed individual press control signal obtained by extracting a specific range of the high-speed line master control signal including the press region.

5. The tandem press line according to claim 1, wherein the non-synchronized high-speed individual press control signal is an accuracy-maintaining high-speed individual press control signal that is distinct from the individual press control signal that corresponds to the high-speed line master control signal.

6. The tandem press line according to claim 1, wherein the press resynchronization point is set to an upper dead point.

7. The tandem press line according to claim 1, wherein the controller is further configured to:

perform a synchronized low-speed transfer control for each of the plurality of transfer systems by using a low-speed individual transfer control signal that corresponds to and is synchronized with the low-speed line master control signal when the line master control signal has been switched from the high-speed line master control signal to the low-speed line master control signal;

determine whether or not a transfer member of each of the plurality of transfer systems under the synchronized low-speed transfer control is positioned within a return transfer region;

switch the synchronized low-speed transfer control to a non-synchronized high-speed transfer control using a non-synchronized high-speed individual transfer control signal that is not synchronized with the low-speed line master control signal for a transfer system among the plurality of transfer systems having a transfer member that has been determined to be positioned within the return transfer region at least during a period in which the transfer member is positioned within the return transfer region;

stop the non-synchronized high-speed transfer control on condition that the transfer member under the non-synchronized high-speed transfer control has reached a transfer resynchronization point; and switch the non-synchronized high-speed individual transfer control signal to the low-speed individual transfer control signal for resynchronization, and automatically switch the non-synchronized high-speed transfer control that has been stopped to the synchronized low-speed transfer control on condition that a phase of the low-speed line master control signal has become equal to a phase of the non-synchronized high-speed individual transfer control signal.

8. The tandem press line according to claim 7, wherein the non-synchronized high-speed individual transfer control signal is an extracted high-speed individual transfer control signal obtained by extracting a specific range of the high-speed line master control signal including the return transfer region.

9. The tandem press line according to claim 7, wherein the non-synchronized high-speed individual transfer control signal is an escape-exclusive high-speed individual transfer control signal that is distinct from the individual transfer control signal that corresponds to the high-speed line master control signal.

10. The tandem press line according to claim 2, wherein the transfer resynchronization point is set to a transfer intermediate position.

11. The tandem press line according to claim 1, wherein the control system includes plural controllers and non-volatile memories.

* * * * *